US012729555B2

(12) United States Patent
Zobel et al.

(10) Patent No.: US 12,729,555 B2
(45) Date of Patent: Sep. 8, 2026

(54) PARKING SYSTEM COMPRISING AT LEAST TWO PARKING SPACE ROWS

(71) Applicant: KLAUS MULTIPARKING GMBH, Aitrach (DE)

(72) Inventors: Fabian Zobel, Rot an der Rot (DE); Jonas Rabus, Memmingen (DE); Philipp Kartheininger, Fellheim (DE)

(73) Assignee: KLAUS MULTIPARKING GMBH, Aitrach (DE)

( * ) Notice: Subject to any disclaimer, the term of this patent is extended or adjusted under 35 U.S.C. 154(b) by 370 days.

(21) Appl. No.: 18/561,941

(22) PCT Filed: May 2, 2022

(86) PCT No.: PCT/EP2022/061732
§ 371 (c)(1),
(2) Date: Nov. 17, 2023

(87) PCT Pub. No.: WO2022/243019
PCT Pub. Date: Nov. 24, 2022

(65) Prior Publication Data

US 2024/0240484 A1 Jul. 18, 2024

(30) Foreign Application Priority Data

May 17, 2021 (DE) ..... 10 2021 112 694.0

(51) Int. Cl.
*E04H 6/22* (2006.01)

(52) U.S. Cl.
CPC ..... *E04H 6/22* (2013.01)

(58) Field of Classification Search
CPC ..... E04H 6/22
See application file for complete search history.

(56) References Cited

U.S. PATENT DOCUMENTS 2,303,656 A * 12/1942 Orr ..... E04H 6/26 414/233
2,569,393 A 9/1951 Walker
5,022,808 A 6/1991 Blum et al.
(Continued)

FOREIGN PATENT DOCUMENTS

DE 1230191 B 12/1966
DE 1248904 B 8/1967
(Continued)

OTHER PUBLICATIONS

European Office Action for European Application No. 22726135.1-1005 dated Dec. 3, 2025 (6 pages).
(Continued)

*Primary Examiner* — Jonathan Snelting
(74) *Attorney, Agent, or Firm* — REISING ETHINGTON, P.C.

(57) ABSTRACT

The disclosure relates to a parking system comprising a first row of parking spaces and a second row of parking spaces. Access to the first row is from an entrance at an entrance level. Access to the second row is by means of a movable feeder platform that bridges a parking space gap in the first row. The feeder platform can be lifted by means of a lifting mechanism from a lowered home position to a crossing position at a passage level.

16 Claims, 6 Drawing Sheets

(56) References Cited

U.S. PATENT DOCUMENTS

| | | | | |
|---|---|---|---|---|
| 5,810,539 | A * | 9/1998 | Zhang | E04H 6/225 414/234 |
| 6,106,210 | A * | 8/2000 | Toxer | E04H 6/22 414/234 |
| 11,149,460 | B2 * | 10/2021 | Lee | E04H 6/182 |
| 12,123,217 | B2 * | 10/2024 | Zangerle | E04H 6/22 |
| 2019/0301191 | A1 | 10/2019 | Nussbaum | |

FOREIGN PATENT DOCUMENTS

| | | | |
|---|---|---|---|
| DE | 3442919 | A1 | 6/1986 |
| DE | 102018107807 | A1 | 10/2019 |
| EP | 1762674 | A2 | 3/2007 |
| WO | WO8904900 | A1 | 6/1989 |

OTHER PUBLICATIONS

International Search Report for International Application No. PCT/EP2022/061732 dated Jul. 5, 2022 (15 pages).
English Translation of International Search Report for International Application No. PCT/EP2022/061732 dated Jul. 5, 2022 (2 pages).
German Office Action for German Application No. 10 2021 112 694.0 dated Jan. 13, 2022 (5 pages).

* cited by examiner

PARKING SYSTEM COMPRISING AT LEAST TWO PARKING SPACE ROWS

INTRODUCTION

The disclosure concerns a parking system.

Under the brand Parkolay, Otomatik Otopark Sistemleri sells a multi-row parking system with the name Parkkonfor 110 Pass Through. Here and in other parking systems not in public use, an individual parking space in the form of a parking platform is assigned to each vehicle keeper. The individual parking platforms are not used for crossing but solely for parking of a particular vehicle. Usually, the parking platforms are specially modified for this with wheel stops and chocks so that the vehicle can easily be positioned precisely on the parking platform. Access to the second row of parking spaces takes place via the first row, in which one parking space gap always remains clear. Parking platforms in the first row are mounted displaceably in the transverse direction, so that the parking space gap can be positioned in front of a specified parking space in the second parking space row. So that this specified parking space in the second parking space row is accessible via the parking space gap, a crossing facility is required. For this, the Parkolay parking system uses a feeder platform which takes up approximately one parking space and is mounted below the parking platforms in the first parking space row, and driven so as to be laterally displaceable independently of these parking platforms. Thus the feeder platform can be maneuvered to the position of the parking space gap. Once arrived there, it can be crossed by a vehicle which thus accesses the second parking space row.

The disadvantage with this parking system is that, because of the low arrangement of the feeder platform, a level passage cannot be achieved and steps must be crossed. This is uncomfortable and sports cars in particular may be unable to cross. Also, in particular when climbing up a step, the driver may accidentally trigger high acceleration. Also, drives and controls are necessary for moving the feeder platform. Finally, no components such as supports can be arranged over the entire movement path of the feeder platform. The feeder platform correspondingly requires a great deal of clear installation space. Above all, parking space height of a parking platform or parking platform row arranged below the feeder platform is lost—at least to the extent taken up by the height of the feeder platform—along the entire projection of the feeder platform over the movement path.

SUMMARY

An object of the disclosure, per an embodiment, is to overcome these disadvantages and provide a parking system which, with few resources and little production complexity, allows comfortable movement of a vehicle from the entrance to the second parking space row, wherein the individual parking spaces are as large as possible while retaining small installation dimensions.

The disclosure, per an embodiment, concerns a parking system comprising a first row of parking spaces and a second row of parking spaces, wherein access to the first row takes place from an entrance at an entrance level, and wherein access to the second row takes place by means of a movable feeder platform which bridges a parking space gap in the first row. It is provided that the feeder platform can be lifted by means of a lifting mechanism from a lowered home position into a crossing position at a passage level.

Optionally, further parking spaces may be arranged on the side of the second parking space row opposite the first row, in particular for example a third or fourth row of parking spaces. Also, the entrance may be formed either by a (static) entrance path or via a further row of parking spaces.

The lifting mechanism allows the feeder platform to be raised in targeted fashion for crossing, so as to compensate for any unevenness in the passage. Preferably, per an embodiment, the home position lies below the entrance level. Here, the feeder platform does not disrupt any other movement processes of the parking system when not in use. The passage level preferably lies at the entrance level. Accordingly, a level transition from the entrance to the feeder platform is achieved. Furthermore, the first and/or second row of parking spaces lie at the entrance level. This is particularly comfortable. The passage level corresponds to the height level of the first and/or second row of parking spaces. This also contributes to comfortable crossing. In particular, multiple adjacent parking spaces in the first row each have such a feeder platform. The feeder platform is not designed to be laterally movable, but in particular can execute exclusively lifting movements. Thus substantially less parking space height below the feeder platform is lost than with feeder platforms which move sideways. The driving level is arranged on the top of the feeder platform, which may have downward-pointing cheeks on the long sides. The latter give the feeder platform stability. In cross-section, the feeder platform has a basic contour in an inverted U-shape. Then clear space is available between the cheeks or legs for the parking space below the feeder platform.

In particular, the parking system may have a first row of parking spaces with parking platforms mounted laterally displaceably, and a second row of parking spaces. The parking spaces in the second row may also be formed on movable platforms or they may be stationary parking areas e.g. typically parking spaces in buildings.

According to a particular embodiment of the parking system, the feeder platform at the passage level forms a level passage to the second row. This is particularly comfortable.

In a more detailed embodiment, the lifting mechanism has a lift drive which drives a lifting movement of a parking platform arranged below the feeder platform, and the lifting mechanism has a carrier device via which lifting movements of the parking platform arranged below the feeder platform act on the feeder platform. Thus no separate lift drive is required for the feeder platform. In particular, the feeder platform is configured without drive. Thus it is economic, not susceptible to fault, requires few resources and little maintenance. Also, it is comparatively easy to retrofit a feeder platform since it has no drive system. The parking platform below the feeder platform can perform exclusively upward and downward movements. In particular, it cannot perform sideways movements. Such a parking platform below the feeder platform can be arranged in a pit, in particular a pit below the entrance level.

Per an embodiment, it is provided that by means of the carrier device, the lifting movement of the parking platform arranged below the feeder platform is for part of the time decoupled from the movement of the feeder platform, and for part of the time coupled to the movement of the feeder platform. In decoupled state, in particular the feeder platform exerts no forces on the parking platform which would otherwise have to be supported by the parking platform or its lift drive. Accordingly, the parking platform and its optional lift drive may be designed less strongly. In decoupled state, the feeder platform is lowered to the passage level, for example onto a frame or support structure of the parking system.

In particular, the carrier device may have at least one coupling element which corresponds to a carrier such that the coupling element comes into contact with the carrier when the distance between the feeder platform and the lower parking platform becomes less than a minimum distance, such that the feeder platform is movement-coupled to the parking platform when the distance is less than the minimum distance. When therefore the parking platform is lifted closer to the feeder platform, after a particular time—namely when reaching the minimum distance—the latter is also lifted. In particular, this occurs when there is no vehicle on the feeder platform. Accordingly, only the weight of the feeder platform must be carried by the parking platform.

Furthermore, it may be provided that when the minimum distance is exceeded, the feeder platform is movement-decoupled from the parking platform, in particular in that the coupling element detaches from the carrier when the minimum distance is exceeded. Accordingly, then the parking platform carries neither the own weight of the feeder platform nor any crossing loads which act on the feeder platform. Without such decoupling, the lift drive of the parking platform would have to be designed to carry the weight of the parking platform, a vehicle parked thereon, the feeder platform and a vehicle crossing over the feeder platform. The decoupling therefore allows the use of substantially weaker drives and constructions.

In a particular embodiment, the carrier device has at least a second, preferably at least a third and particularly preferably precisely four coupling elements, per varying embodiments, wherein each coupling element corresponds to a carrier such that, when the distance is less than a minimum distance from the parking platform arranged below the feeder platform, the coupling elements each make contact with one of the carriers so that the feeder platform is movement-coupled to the parking platform arranged below the feeder platform when the distance is less than the minimum distance. Multiple pairs of coupling elements and carriers allow these to be arranged spaced apart. Thus the loads are evenly transmitted between the platform and the feeder platform. Preferably per an embodiment, viewed from above, the coupling elements and/or the carriers are arranged on the periphery of the feeder platform and/or the parking platform arranged below this. Thus the size of the parking space of the parking platform is only slightly influenced, or not at all influenced. It is particularly preferred per an embodiment if, viewed from above, the coupling elements and/or the carriers are arranged on the long sides (or sides extending between the entrance and the second row) of the feeder platform and/or the parking platform. Accordingly, any coupling elements and carriers are positioned only at the sides of a parking vehicle, and not in front of or behind the vehicle in the direction of travel. If there are more than three pairs of coupling elements and carriers, the feeder platform can stand stably on the platform in the fashion of a three-legged table, without in particular the carrier device having to absorb torsional moments.

In a particular embodiment, the or each coupling element is formed by a contact plate and the or each carrier by a support, in particular a rigid and driveless support. With such a support, the distance between the feeder platform and the parking platform arranged below this can be bridged and the forces can easily be dissipated. For this, the support should be straight. It is also suitable if the support is oriented geodetically vertically. The contact plate may come into contact with a free end of the support. Alternatively, a coupling geometry may be formed or arranged on the support which corresponds to the contact plate. Preferably, per an embodiment, the contact plates detach from the respective supports as soon the minimum distance is exceeded, in particular if the feeder platform is locked at the entrance level. Preferably, per an embodiment, the parking platform may be lowered with no load on its lift drive. The minimum distance should then be exceeded by maximum 20 cm, preferably even less. This could be called the decoupling distance. This achieves firstly that the parking space height of the parking platform is reduced only by this decoupling distance, and secondly, despite flexion of the feeder platform, the decoupling is maintained under load.

Optionally, the support or supports may be arranged on the parking platform below the feeder platform, and the contact plate or plates on the feeder platform. Alternatively however, the reverse may also be implemented.

A linear guide, which remains in engagement in all operating positions, may be provided between the coupling element and the carrier. This ensures that the coupling element and carrier are always correctly positioned relative to one another without for example a support having to be connected to one of the platforms particularly rigidly. The coupling elements and carriers may for example also be configured as a type of fluidless, undriven lifting cylinder with a stop at the maximum length and a stop at the minimum length.

Furthermore, the parking platform arranged below the feeder platform can be lifted by the lifting mechanism up to the passage level, wherein the feeder platform is also lifted beyond the passage level. Thus the feeder platform is also easily lifted when parking or unparking on the parking platform.

The feeder platform is configured so as to be lowerable or attachable or fixable at the passage level. Then the feeder platform is mounted stably in the passage position—in particular without e.g. drives having to bear loads—and can be crossed by a vehicle. In particular, per an embodiment, the feeder platform is self-supporting in the position at the passage level and in particular has no fixed connection to other parking platforms. All forces may thus be transmitted from the feeder platform directly to a frame or a support structure of the parking system.

In principle, the feeder platform may be lowered to the passage level by defined movement sequences. Thus for example the feeder platform may be moved with an upward or downward slope, and then be levelled and lowered or attached at the passage level. Also for example, small sideways movements of the feeder platform are conceivable, by means of which the feeder platform could be lowered or attached at the passage level.

In a particular embodiment, the parking system has a fixing device which, in controlled and/or switching fashion, assumes either a first or a second state; wherein in the first state, the fixing device blocks a lowering of the feeder platform below the passage level and/or fixes the feeder platform at the passage level, and wherein in the second state of the fixing device, a lowering of the feeder platform below the passage level is permitted. Such fixing devices may be implemented with small electronic components without in particular the feeder platform having to execute a complex movement in order to be lowered and moved away again.

Preferably, per an embodiment, in passive state, the fixing device assumes the first state and only assumes the second state when activated. Accordingly, the feeder platform cannot be lowered below the passage level without being activated.

It is furthermore preferred, per an embodiment, if the feeder platform loads the fixing device in the direction of the first state. Accordingly, a self-locking in the lowered position is achieved, which in particular can only be overcome by raising the feeder platform.

It may be also advantageous, per an embodiment, if, in the first state of the fixing device, the parking platform arranged below the feeder platform can be lowered so far that the distance between the parking platform arranged below the feeder platform and the feeder platform is greater than the minimum distance, wherein the feeder platform is fixed at the passage level. Then a weight decoupling is achieved in which the platform does not have to carry the feeder platform and bear the loads acting thereon. Here too, the distance should not exceed the minimum distance by more than 20 cm, and preferably less. Then the parking space height of the platform is restricted as little as possible. A vehicle on the parking platform must namely be able to remain there when the parking platform is being raised and the feeder platform approaches the minimum distance. The parking platform below the feeder platform can preferably be lowered completely. Then a frame or support structure of the parking system is not loaded by this platform and may e.g. absorb higher forces which act on the feeder platform.

It may be particularly advantageous, per an embodiment, if, in the first state of the fixing device, when the feeder platform is held by the fixing device at the passage level, the parking platform arranged below the feeder platform can be lowered so far that it comes to rest and is relieved of the load of the feeder platform. Thus firstly a lift drive of the parking platform is fully unloaded by this support and secondly no forces of the feeder platform act on the parking platform.

According to an optional embodiment, the parking platform arranged below the feeder platform can be lifted so far that the feeder platform is liftable beyond the passage level, and can be lowered such that in the first state of the fixing device, the feeder platform is positionable at the passage level. This allows any locking elements of the fixing device to be brought into position with low forces and also secured in the holding position after positioning of the feeder platform. To a certain extent, the feeder platform is first overlifted and only then lowered, instead of being lifted only to the passage level.

Optionally, the fixing device has at least one, preferably per an embodiment at least two locking elements via which, in the first state of the fixing device, the feeder platform is locked to a frame of the parking system. This may be particularly economic and can be implemented with simple movement sequences of the feeder platform. Preferably, per an embodiment, the locking element or elements are arranged on the frame and, in the first state of the fixing device, are in engagement with the feeder platform. This arrangement on the frame allows the use of power and control lines which are stationary and at rest, and which are less susceptible to wear than e.g. moved lines.

In a more detailed embodiment, it is provided that the fixing device has a switching controller which switches between the first and second state when the feeder platform exceeds a switching height which is higher than the passage level. Accordingly, switching is made dependent on certain positions of the feeder platform and is therefore reliable.

Furthermore, an embodiment is suitable in which the parking system has at least one displaceable parking platform in the first row of parking places, which is mounted so as to be displaceable along the first row, wherein in the lowered home position of the feeder platform, the displaceable parking platform can move over the feeder platform, and wherein in the crossing position of the feeder platform, the displaceable parking platform cannot move over the feeder platform. This deploys the full advantage of the feeder platform which can be raised to the passage level, per certain embodiments. Preferably, per an embodiment, the displaceable parking platform has a U-shaped cross-section, wherein the parking surface for a vehicle to be parked lies between the legs of the U-shaped cross-section. Thus it is possible to position the driving level of the feeder platform and the parking surface of the displaceable parking platform close together. Thus the home position of the feeder platform below the displaceable platform lies only slightly lower than the position at the passage level. Accordingly, little parking space height is lost at the parking space of the platform below the feeder platform. In principle however, other embodiments may also be considered in which the first row contains no longitudinally displaceable parking platform.

BRIEF DESCRIPTION OF THE FIGURES

Further features, details and advantages of the invention arise from the wording of the claims and the following description of exemplary embodiments illustrated in the drawings. The drawings show:

DETAILED DESCRIPTION

Figure 1:
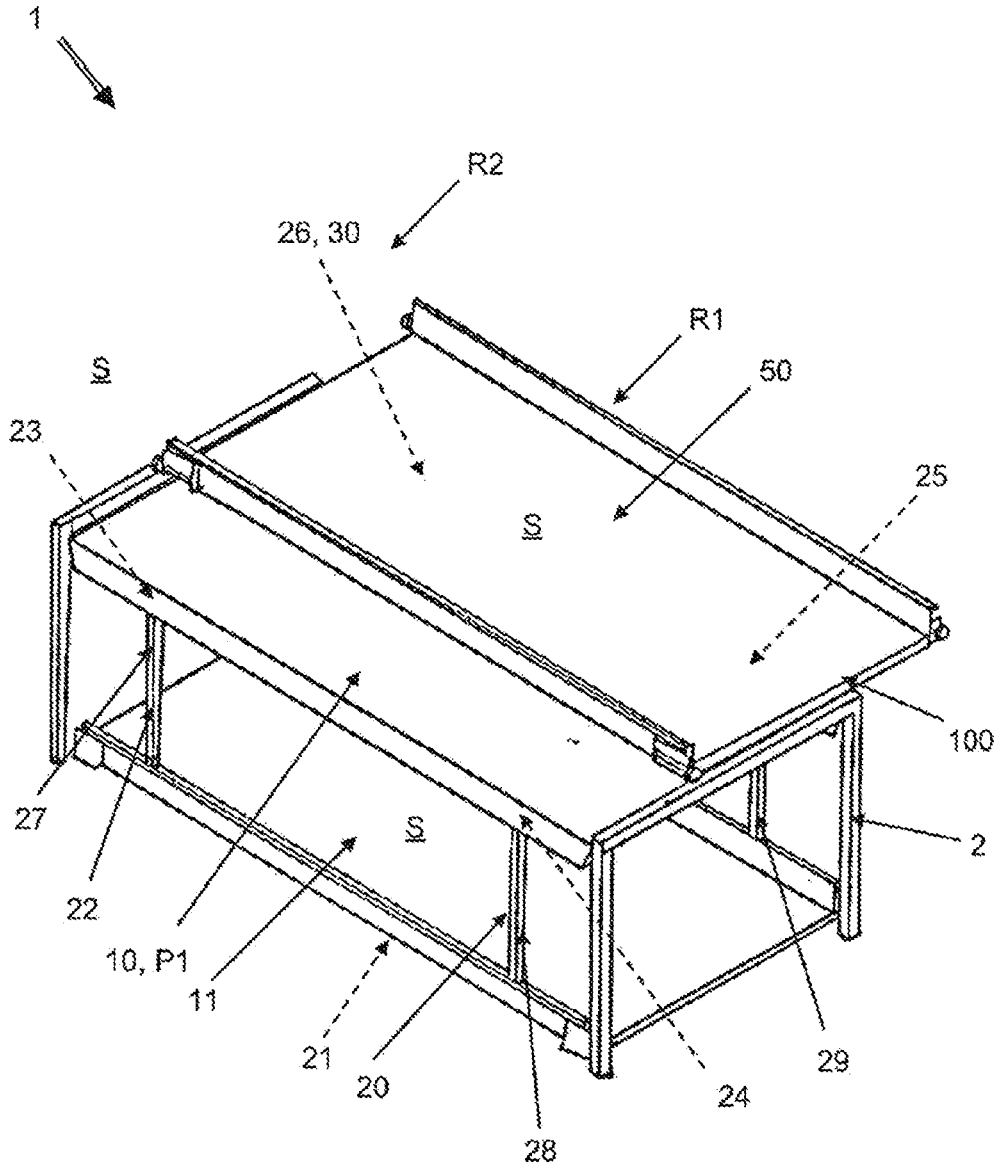
FIG. 1 a perspective view of a parking system.

FIG. 1 shows a perspective view of a parking system 1 with a first row R1 of parking spaces S with laterally displaceable parking platforms 50, and an indicated second row R2 of parking spaces S which has parking platforms or also regular parking spaces in buildings.

Access to the first row R1 takes place via an entrance 100 at an entrance level. Access to the second row R2 takes place by means of a movable feeder platform 10 on which no vehicles are parked. The feeder platform is configured to bridge a parking space gap in the first row R1 so that a vehicle can drive from the entrance into the second row R2.

Figure 5:
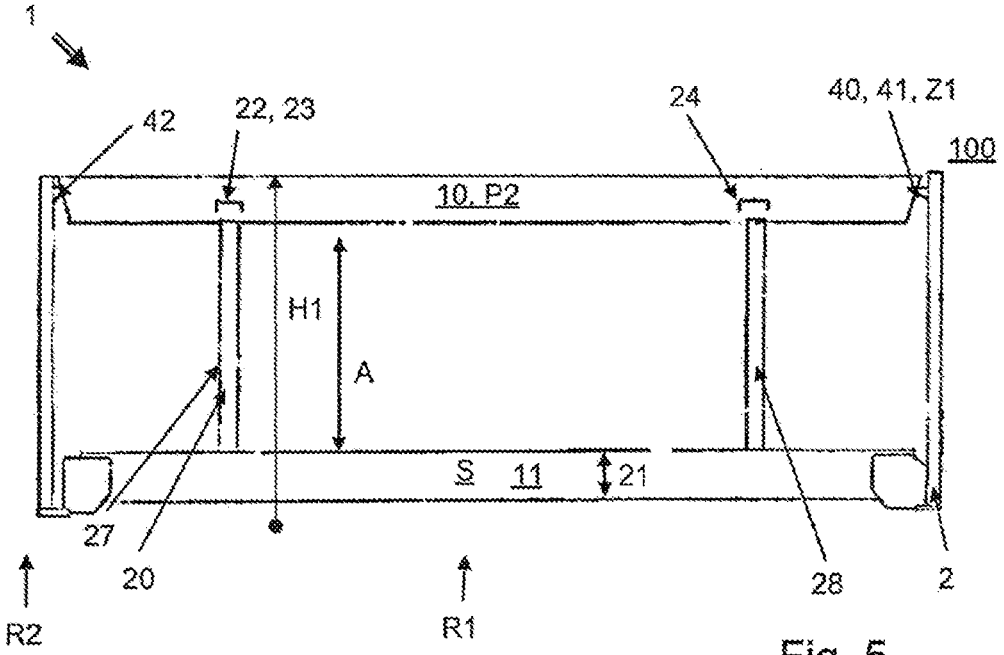
FIG. 5 a schematic side view of a parking system, wherein a feeder platform is lowered to a passage level.
Figure 6:
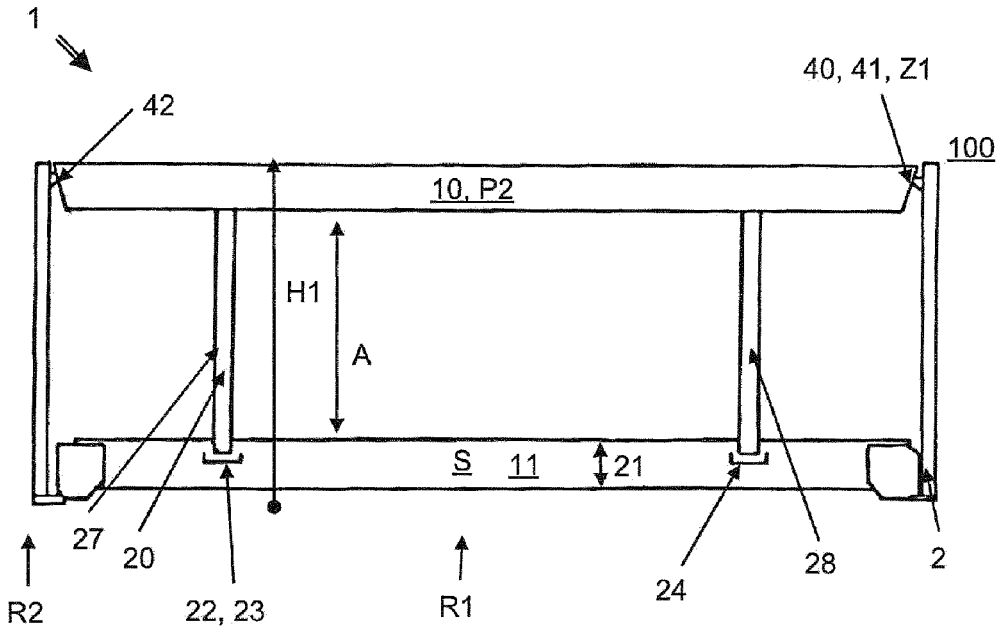
FIG. 6 a schematic side view of a further parking system, wherein a feeder platform is lowered to a passage level.

The feeder platform 10 can be lifted by means of a lifting mechanism 20 from a lowered home position P1 as shown into a crossing position P2 (see FIGS. 5 and 6).

Figure 2:
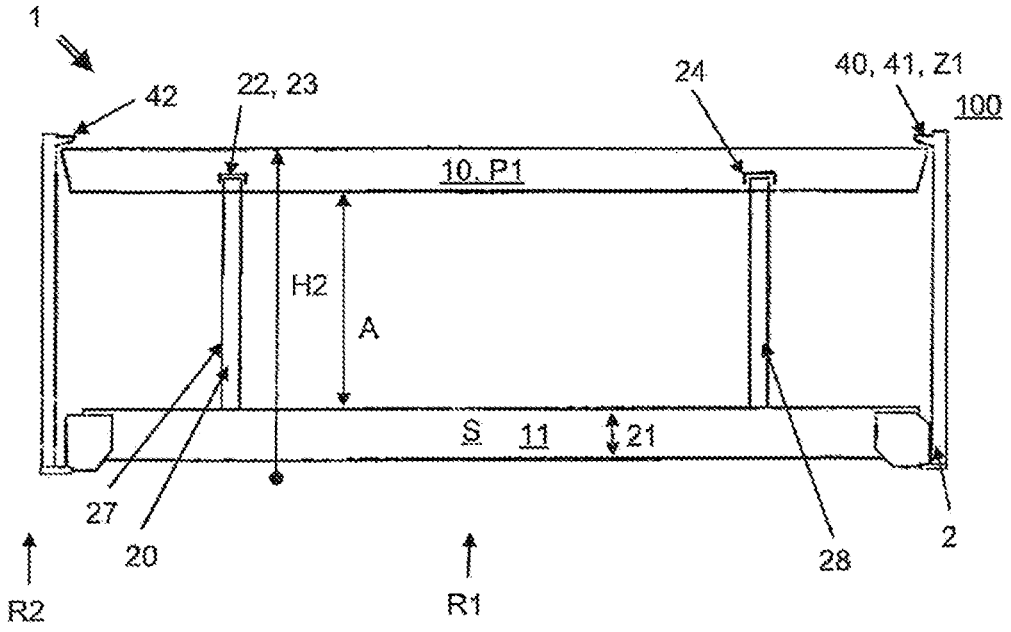
FIG. 2 a schematic side view of a parking system, wherein a feeder platform is arranged in a home position.
Figure 3:
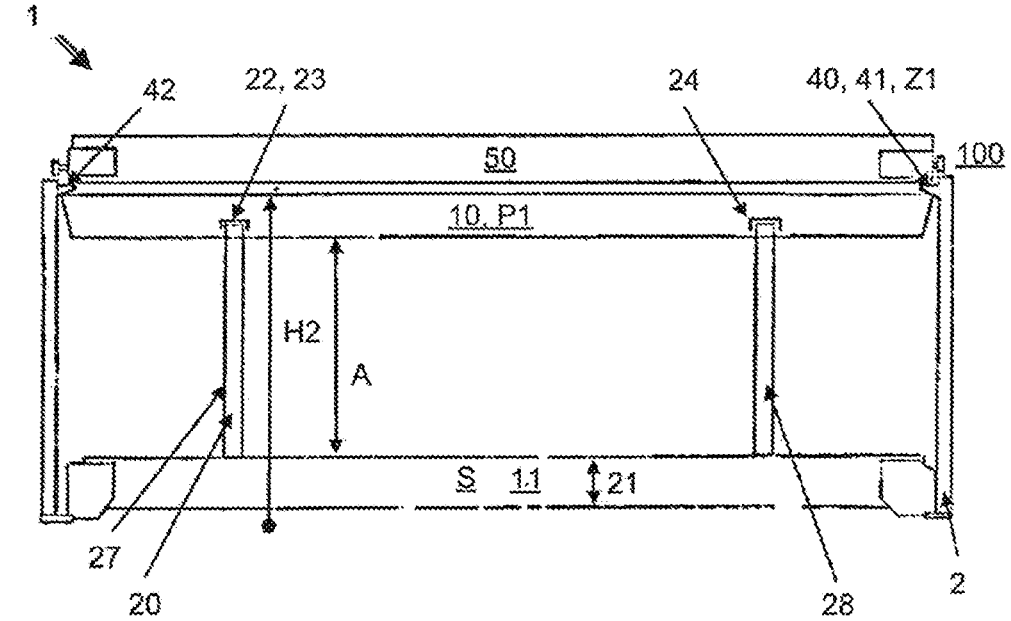
FIG. 3 a schematic side view of a parking system, wherein a feeder platform is arranged in a home position and a parking platform has been moved over the feeder platform.

The home position P1 shown here is also illustrated in FIGS. 2 and 3, wherein here the feeder platform 10, in particular its surface level, lies below the entrance level (see reference sign N in FIGS. 7, 8 and 9). The first and/or second row R1, R2 of parking spaces S, in particular their parking surfaces, however always lie at the entrance level.

The lifting mechanism 20 has a (merely indicated) lift drive 21 which drives a lifting movement of a parking platform 11 arranged below the feeder platform 10. This mechanism may for example comprise lifting cylinders, synchronizing devices and chain hoists. The lifting mechanism 20 also has a carrier device 22 with which lifting movements of the parking platform 11 arranged below the feeder platform 10 act on the feeder platform 10. The feeder platform 10 as such has no drive. Instead, the carrier device 22 ensures that the lifting movement of the parking platform 11 arranged below the feeder platform 10 is for part of the time decoupled from the movement of the feeder platform 10 and for part of the time coupled to the movement of the feeder platform 10.

The carrier device 22 has precisely four coupling elements 23, 24, 25, 26 which each correspond to a carrier 27, 28, 29, 30 such that the coupling element 23, 24, 25, 26 is in contact with the carrier 27 when the distance between the feeder platform 10 and the lower parking platform 11 is less than a minimum distance (see reference sign A in FIGS. 2, 3 4), such that when the distance is less than the minimum distance A, the feeder platform 10 is movement-coupled to the parking platform 11. When the minimum distance A is exceeded, the feeder platform 10 is however movement-decoupled from the parking platform 11, in that the coupling element 23 detaches from the carrier 27 when the minimum distance A is exceeded. This is particularly evident in FIGS. 5, 6 and 8.

The coupling elements 23, 24, 25, 26 and the carriers 27, 28, 29, 30 are arranged on the periphery of the feeder platform 10 viewed from above. Here in particular, in each case two of the coupling elements 23, 24, 25, 26 and two of the carriers 27, 28, 29, 30 sit spaced apart from one another on the long sides of the feeder platform 10, namely on the sides which extend between the entrance 100 and the second row R2.

As evident from FIGS. 2 to 9, the coupling elements 23, 24, 25, 26 are each formed by a contact plate, and the carriers 27, 28, 29, 30 are each formed by a rigid driveless support.

According to FIGS. 2 to 5 and 7 to 9, the supports are each attached to the parking platform 11 arranged below the feeder platform 10, and the contact plates are arranged on the feeder platform 10. In FIG. 6, the arrangement is reversed. There the supports are each attached to the feeder platform 10 and the contact plates are formed on the parking platform 11 arranged below the feeder platform 10.

Figure 8:
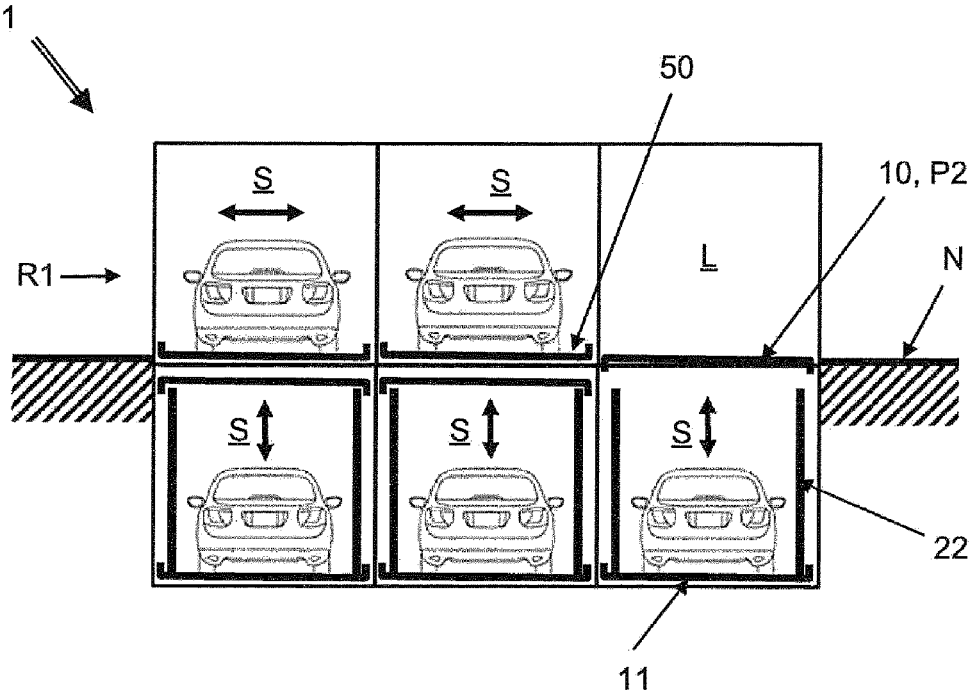
FIG. 8 a schematic sketch of the function of a parking system, wherein a feeder platform is lowered to a passage level.
Figure 9:
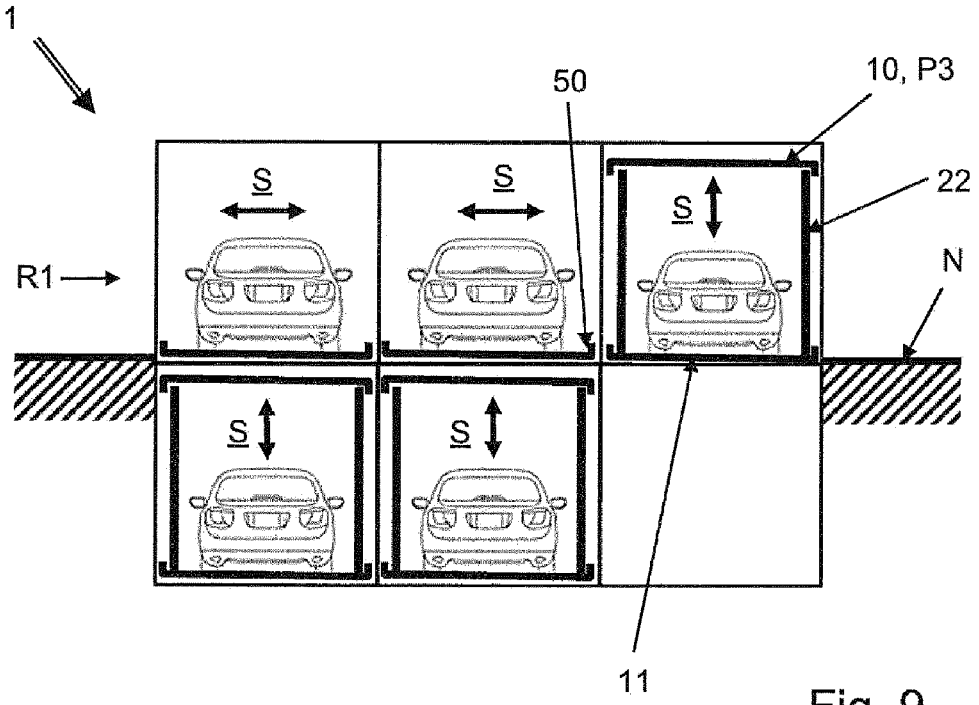
FIG. 9 a schematic sketch of the function of a parking system, wherein a feeder platform is raised above a passage level.

These contact plates each detach from their assigned support as soon as the minimum distance A is exceeded, in particular when the feeder platform 10, as shown in FIGS. 5 and 8, is locked at the passage height H1.

As shown in particular in FIG. 5, the feeder platform 10—as illustrated in FIG. 1—can be lifted and is lowerable or attachable or fixable at the passage level H1. The passage level H1 lies at the entrance level of the entrance 100. The passage level H1 also corresponds to the height level of the first and second rows R1, R2 of parking spaces S. Thus the feeder platform 10 at passage level H1 forms a level passage to the second row R2.

Figure 4:
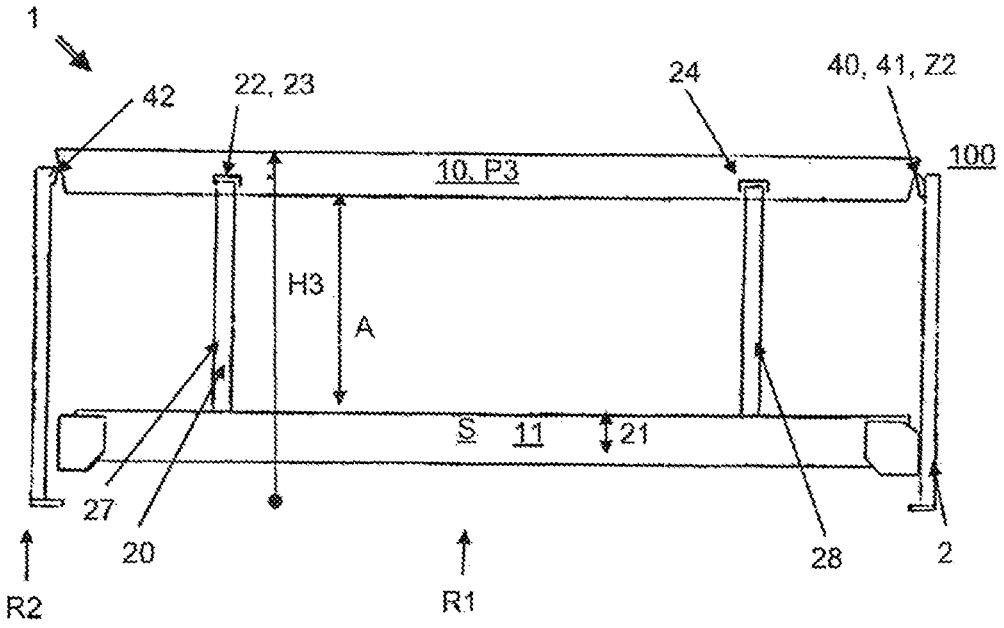
FIG. 4 a schematic side view of a parking system, wherein a feeder platform is arranged above a passage level.

As evident in particular from FIGS. 2 to 6, which each illustrate a parking system as shown in FIG. 1, the parking system 1 has a fixing device 40. Under control and/or by switching, this assumes either a first or a second state Z1, Z2. In the first state Z1 as illustrated in FIGS. 2, 3 and 5, the fixing device 40 blocks a lowering of the feeder platform 10 below the passage height H1, or fixes the feeder platform 10 at the passage height H1. In the illustrations in FIGS. 2 and 3, in which the feeder platform 10 is arranged below the passage level H1, this serves in particular for safety since, as soon as the feeder platform 10 as illustrated in FIG. 4 is lifted beyond a switching height H3, the feeder platform 10 can no longer be lowered below the passage height H2 without switching to state Z2. Only in the second state Z2 of the fixing device 40 is lowering of the feeder platform 10 below the passage height H1 permitted.

When the feeder platform 10 is fixed at passage height H1, as evident in particular in FIGS. 5 and 6, the parking platform 11 arranged below the feeder platform 10 can be lowered so far that the distance between the parking platform 11 arranged below the feeder platform 10 and the feeder platform 10 is greater than the minimum distance A. Accordingly, the parking platform 11 arranged below the feeder platform 10 no longer carries the feeder platform 10. Rather, the feeder platform 10 is lowered to the passage height H1 and in particular loads the frame 2 of the parking system 1. The parking platform 11 arranged below the feeder platform 10 can be lowered so far that it rests on a stop or on the ground. This relieves the load on the lift drive 21.

As evident in particular from FIG. 4, the parking platform 11 arranged below the feeder platform 10 can be raised so far that the feeder platform 10 is raised above the passage level H1 and is only then lowered and comes to rest at the passage level H1 in the first state Z1 of the fixing device 40 as shown in FIG. 5. This over-lifting serves for smooth drive of the fixing device 40 and secures the fixing device 40 in the first state Z1. Only when the feeder platform 10 is raised again can the fixing device 40 switch to state Z2 and the feeder platform 10 can then be lowered.

According to FIGS. 2 to 6, the fixing device 40 has at least two locking elements 41, 42 via which, when the fixing device 40 is in the first state Z1, the feeder platform 10 is locked to the frame 2 of the parking system 1. The locking elements 41, 42 are arranged on the frame 2 and, when the fixing device 40 is in the first state Z1, stand in engagement with the feeder platform 10 as soon as this has been lowered onto the locking elements 41, 42 at the passage level H1.

The fixing device 40 has a switching controller or switching mechanism which switches between the first and second state Z1, Z2 when the feeder platform 10 exceeds a switching height H3 which is higher than the passage level H1, as shown in FIG. 4.

Figure 7:
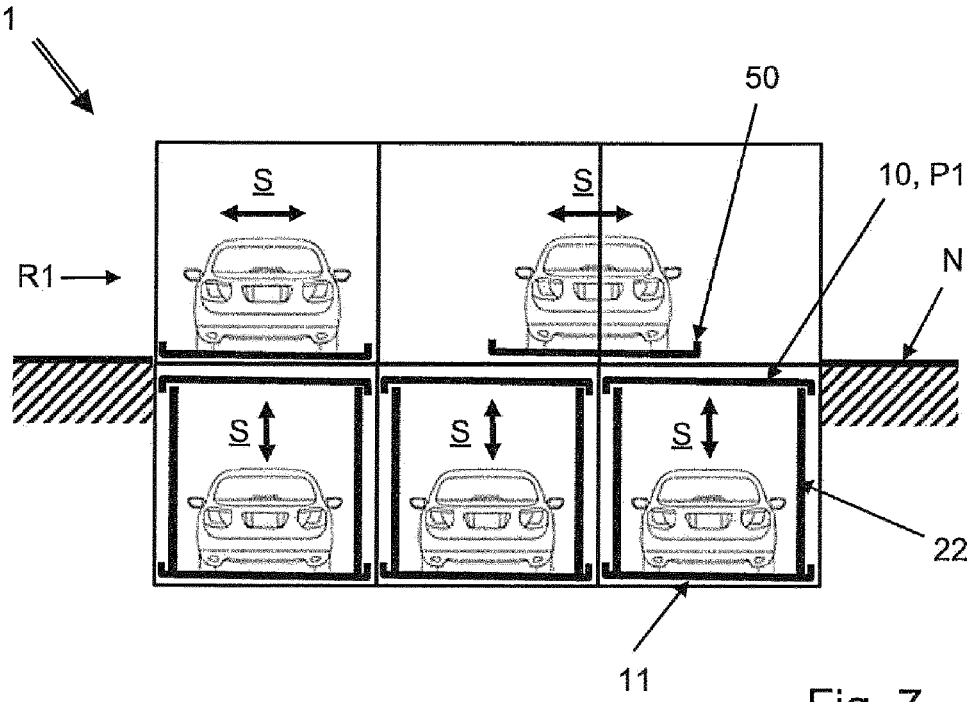
FIG. 7 a schematic sketch of the function of a parking system, wherein a feeder platform is arranged in a home position and a parking platform is partially moved over the feeder platform.

As FIGS. 1, 3 and 7 show, the parking system 1 has at least one displaceable parking platform 50 in the first row R1 of parking spaces S, which is movable along the first row R1. When the feeder platform 10 is in the lowered home position P1, the displaceable parking platform 50 can be moved over the feeder platform 10. As evident however in FIG. 8, the displaceable parking platform 50 cannot be moved over the feeder platform 10 when the latter has been raised to the crossing position P2.

FIGS. 7, 8 and 9 again show schematically the function of the parking system 1. In a first row R1 of parking spaces S comprising multiple laterally displaceable parking platforms 50, a parking space gap L has been left clear. Thus the parking space gap L can be positioned in front of any parking space in a second row of parking spaces S. Parking platforms 11 are arranged in a pit below the surface level N and are each driven via a lift drive in order to be lifted and lowered. Just below the surface level in FIG. 7, a feeder platform 10 is arranged in a home position P1 and via a carrier device 22 loads the parking platform 11 arranged underneath.

According to FIG. 7, the laterally displaceable parking platforms 50 are moved from right to left in order to form the parking space gap L on the right as shown in FIG. 8.

Then according to FIG. 8, the feeder platform 10 can be raised to a crossing position P2. A vehicle can now drive from the entrance over the feeder platform 10 into the second row of parking spaces S. As shown in FIG. 8, the feeder platform 10 is fixed in the crossing position P2 and decoupled from the parking platform 11 arranged below. Accordingly, the own weight of the feeder platform 10 and the forces of the crossing vehicle do not act on the parking platform 11.

To unpark the vehicle on the parking platform 11, this can easily be lifted to the entrance level N, wherein the feeder platform 10 is easily also lifted.

As used herein, the terms "general," "generally," and "approximately" are intended to account for the inherent degree of variance and imprecision that is often attributed to, and often accompanies, any design and manufacturing process, including engineering tolerances, and without deviation from the relevant functionality and intended outcome, such that mathematical precision and exactitude is not implied and, in some instances, is not possible.

The invention is not restricted to one of the above-described embodiments but may be modified in many ways.

All features and advantages arising from the claims, the description and the drawing, including structural details, spatial arrangements and method steps, may be essential to the invention both alone and in widely varying combinations.

All the features and advantages, including structural details, spatial arrangements and method steps, which follow from the claims, the description and the drawing can be fundamental to the invention both on their own and in different combinations. It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

List of reference numerals

| | |
|---|---|
| 1 | Parking system |
| 2 | Frame |
| 10 | Feeder platform |
| 11 | Parking platform arranged below feeder platform |
| 20 | Lifting mechanism |
| 21 | Lift drive |
| 22 | Carrier device |
| 23 | Coupling element |
| 24 | Coupling element |
| 25 | Coupling element |
| 26 | Coupling element |
| 27 | Carrier |
| 28 | Carrier |
| 29 | Carrier |
| 30 | Carrier |
| 40 | Fixing device |
| 41 | Locking element |
| 42 | Locking element |
| 50 | Displaceable parking platform |
| 100 | Entrance |
| A | Minimum distance |
| H1 | Passage level |
| H2 | Lowered height |
| H3 | Switching height |
| L | Parking space gap |
| N | Entrance level |
| P2 | Crossing position |
| P3 | Over-lift position |
| R1 | First row of parking spaces |
| R2 | Second row of parking spaces |
| S | Parking space |
| Z1 | First state (of fixing device) |
| Z2 | Second state (of fixing device) |

The invention claimed is:

1. A parking system comprising a first row of parking spaces and a second row of parking spaces, wherein access to the first row takes place from an entrance at an entrance level, and wherein access to the second row takes place via a movable feeder platform which bridges a parking space gap in the first row, wherein the feeder platform can be lifted via a lifting mechanism from a lowered home position into a crossing position at a passage level, wherein the lifting mechanism has a lift drive which drives a lifting movement of a parking platform arranged below the feeder platform, and the lifting mechanism has a carrier device via which lifting movements of the parking platform arranged below the feeder platform act on the feeder platform, wherein via the carrier device, the lifting movement of the parking platform arranged below the feeder platform is for part of the time decoupled from the movement of the feeder platform, and for part of the time coupled to the movement of the feeder platform.

2. The parking system as claimed in claim 1, wherein the feeder platform at the passage level forms a level passage to the second row.

3. The parking system as claimed in claim 1, wherein the carrier device has at least one coupling element which corresponds to a carrier such that the coupling element comes into contact with the carrier when a distance between the feeder platform and the parking platform arranged below the feeder platform becomes less than a minimum distance, such that the feeder platform is movement-coupled to the parking platform when the distance is less than the minimum distance.

4. The parking system as claimed in claim 3, wherein when the minimum distance is exceeded, the feeder platform is movement-decoupled from the parking platform.

5. The parking system as claimed in claim 3, wherein the carrier device has at least a second coupling element, wherein the coupling element corresponds to a carrier such that when the distance between the feeder platform and the parking platform arranged below the feeder platform becomes less than the minimum distance, the coupling element makes contact with one of the carriers such that the feeder platform is movement-coupled to the parking platform arranged below the feeder platform when the distance is less than the minimum distance.

6. The parking system as claimed in claim 3, wherein the or each coupling element is formed by a contact plate and the or each carrier by a support.

7. The parking system as claimed in claim 1, wherein the parking platform arranged below the feeder platform can be lifted by the lifting mechanism up to the passage level, wherein the feeder platform is also lifted beyond the passage level.

8. The parking system as claimed in claim 1, wherein the feeder platform is configured so as to be lowerable or attachable or fixable at the passage level.

9. The parking system as claimed in claim 1, having a fixing device which in controlled and/or switching fashion assumes either a first or a second state, wherein in the first state, the fixing device blocks a lowering of the feeder platform below the passage level and/or fixes the feeder platform at the passage level, and in the second state of the fixing device, a lowering of the feeder platform below the passage level is permitted.

10. The parking system as claimed in claim 9, wherein in the first state of the fixing device, the parking platform arranged below the feeder platform can be lowered so far that a distance between the parking platform arranged below the feeder platform and the feeder platform is greater than a minimum distance, wherein the feeder platform is fixed at the passage level.

11. The parking system as claimed in claim 9, wherein if, in the first state of the fixing device, the feeder platform is held by the fixing device at the passage level, the parking platform arranged below the feeder platform can be lowered so far that the parking platform comes to rest and is relieved of a load of the feeder platform.

12. The parking system as claimed in claim 9, wherein the parking platform arranged below the feeder platform can be lifted so far that the feeder platform is liftable beyond the passage level, and can be lowered such that in the first state of the fixing device, the feeder platform is positionable at the passage level.

13. The parking system as claimed in claim 9, wherein the fixing device has at least one locking element via which, in the first state of the fixing device, the feeder platform is locked to a frame of the parking system.

14. The parking system as claimed in claim 9, wherein the fixing device has a switching controller which switches between the first and second state when the feeder platform exceeds a switching height which is higher than the passage level.

15. The parking system as claimed in claim 1, having at least one displaceable parking platform in the first row of parking places which is mounted so as to be displaceable along the first row, wherein in the lowered home position of the feeder platform, the displaceable parking platform can move over the feeder platform, and wherein in the crossing position of the feeder platform, the displaceable parking platform cannot move over the feeder platform.

16. A parking system comprising a first row of parking spaces and a second row of parking spaces, wherein access to the first row takes place from an entrance at an entrance level, and wherein access to the second row takes place via a movable feeder platform which bridges a parking space gap in the first row, wherein the feeder platform can be lifted via a lifting mechanism from a lowered home position into a crossing position at a passage level, wherein the lifting mechanism has a lift drive which drives a lifting movement of a parking platform arranged below the feeder platform, and the lifting mechanism has a carrier device via which lifting movements of the parking platform arranged below the feeder platform act on the feeder platform, wherein the carrier device has at least one coupling element which corresponds to a carrier such that the coupling element comes into contact with the carrier when a distance between the feeder platform and the parking platform arranged below the feeder platform becomes less than a minimum distance, such that the feeder platform is movement-coupled to the parking platform when the distance is less than the minimum distance.

* * * * *